US005666894A

United States Patent [19]

Jönsson et al.

[11] Patent Number: 5,666,894

[45] Date of Patent: Sep. 16, 1997

[54] EMBROIDERY UNIT FOR SEWING MACHINE

[75] Inventors: Åke Jönsson, Jönköping; Hans Grufman, Huskvarna, both of Sweden

[73] Assignee: Aktiebolaget Electrolux, Stockholm, Sweden

[21] Appl. No.: 490,646

[22] Filed: Jun. 15, 1995

[30] Foreign Application Priority Data

Aug. 12, 1994 [SE] Sweden ..... 9402710

[51] Int. Cl.[6] ..... D05C 9/04

[52] U.S. Cl. ..... 112/103; 112/470.06

[58] Field of Search ..... 112/103, 102.5, 112/102, 470.06, 78, 2, 260, 270

[56] References Cited

U.S. PATENT DOCUMENTS

| | | | |
|---|---|---|---|
| 4,325,313 | 4/1982 | Kawai et al. | 112/103 |
| 4,388,883 | 6/1983 | Hirota et al. . | |
| 4,763,586 | 8/1988 | Takenoya et al. . | |
| 5,040,474 | 8/1991 | Kamijyo . | |
| 5,231,941 | 8/1993 | Wakayama | 112/103 X |
| 5,284,104 | 2/1994 | Hori | 112/103 X |
| 5,291,843 | 3/1994 | Hori . | |
| 5,386,789 | 2/1995 | Futamura | 112/103 X |

*Primary Examiner*—Peter Nerbun

*Attorney, Agent, or Firm*—Pearne, Gordon, McCoy & Granger LLP

[57] ABSTRACT

An embroidery unit for use with a sewing machine, the sewing machine having a lower free arm (19) with a cloth feed dog (20), a column (16) with a drive unit, and a top arm (17) with a needle bar mechanism (18). The embroidery unit has a housing (10) which can be releasably attached to the free arm of the sewing machine. The housing has a first, stationary arm (11) provided with a first, stepping motor driven slide (12) movable parallel to the free arm. A second, movable arm (13) extends perpendicularly to the free arm and has a free end and an end attached to the first slide. The second arm is movable above the free arm between the feed dog (20) and the column (16) and has a second, stepping motor powered slide (14) carrying a hoop (15) which, by operation of the two slides, is movable in two mutually perpendicular directions. The second arm is movable to an inoperative position adjacent to the column (16) in order to enable normal sewing without having to remove the embroidery unit from the sewing machine.

3 Claims, 3 Drawing Sheets

EMBROIDERY UNIT FOR SEWING MACHINE

BACKGROUND OF THE INVENTION

The present invention relates to an embroidery unit for a sewing machine, wherein the sewing machine has a lower free arm provided with a cloth feed dog, a column with a drive unit, and a top arm with a needle bar mechanism.

Embroidery units which are adapted to be used as an accessory for domestic sewing machines are known in the art. Such embroidery units permit sewing of embroidery patterns which have been electronically stored in the control unit of the machine. Typically, the cloth to be embroidered is fastened in a hoop which is movable by means of a power-driven feeding device in two mutually perpendicular directions. Movement of the power-driven feeding device is controlled by the control unit to produce the desired embroidery pattern.

SUMMARY OF THE INVENTION

One object of the present invention is to provide an embroidery unit which has a simpler design than those previously known, and which allows the sewing machine to be used for normal sewing even when the embroidery unit is attached to the machine.

An embroidery unit according to the present invention is useful as an accessory for a sewing machine having a lower free arm provided with a cloth feed dog, a column with a drive unit, and a top arm having a needle bar mechanism. The embroidery unit includes a housing adapted to be releasably attached to the free arm, and has a first, stationary arm and a second, movable arm.

In further accordance with the present invention, the first arm includes a first, stepping motor powered slide which is adapted to move parallel to the free arm of the sewing machine. The second, movable arm extends perpendicularly to the free arm of the sewing machine and has a free end and an end attached to the first slide. The second arm is movable above the free arm between the feed dog and the column. The second arm has a second, stepping motor powered slide carrying a hoop. The hoop is movable by the slides in two mutually perpendicular directions.

In further accordance with the present invention, the second arm is movable to a storage or inoperable position adjacent the column of the sewing machine. Moving the second arm to the storage position, and removing the hoop from the second arm, allows the machine to be quickly converted from embroidery sewing to standard sewing.

BRIEF DESCRIPTION OF THE DRAWINGS

The invention will be described in more detail in the following with reference to the accompanying drawings, in which.

DETAILED DESCRIPTION OF THE PREFERRED EMBODIMENT

Figure 1:
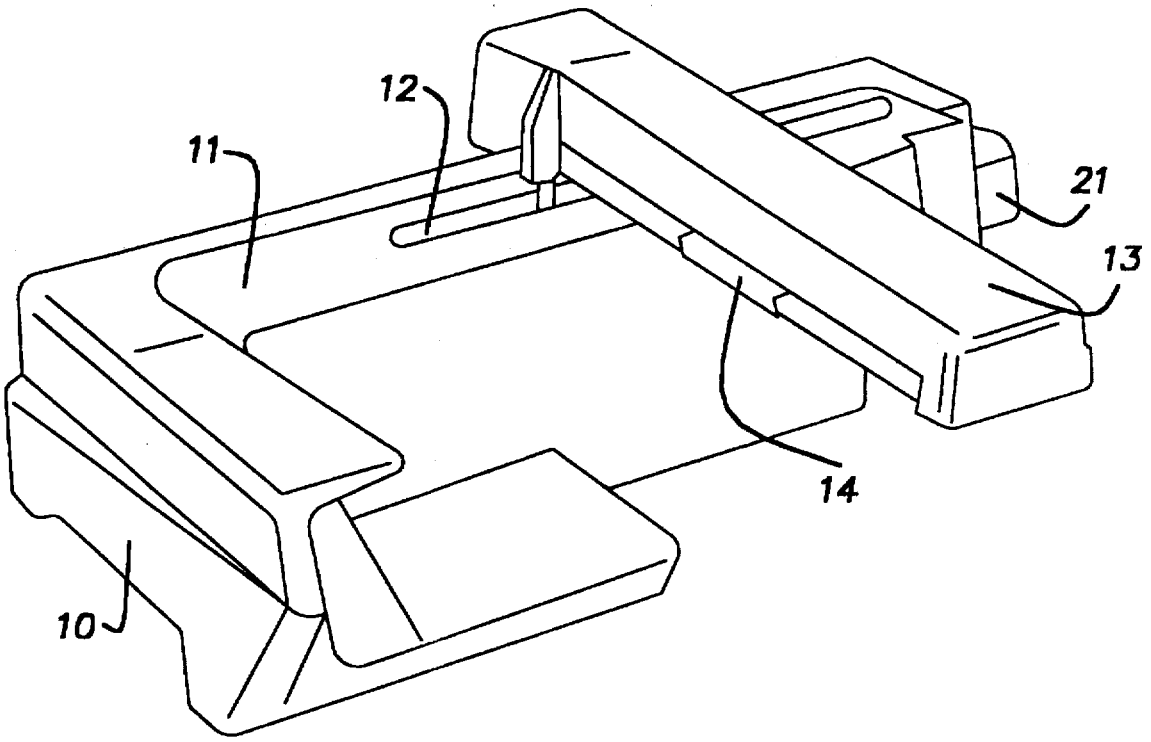
FIG. 1 illustrates a perspective view of an embroidery unit according to the present invention.

With reference to the drawing figures, the embroidery unit of the present invention includes a housing 10 having a first, stationary arm 11 provided with a first slide 12. A second, movable arm 13 is attached at one end to the slide 12, and is provided with a second slide 14 which is movable in the longitudinal or lengthwise direction of the arm 13 and carries a hoop 15.

Figure 2:
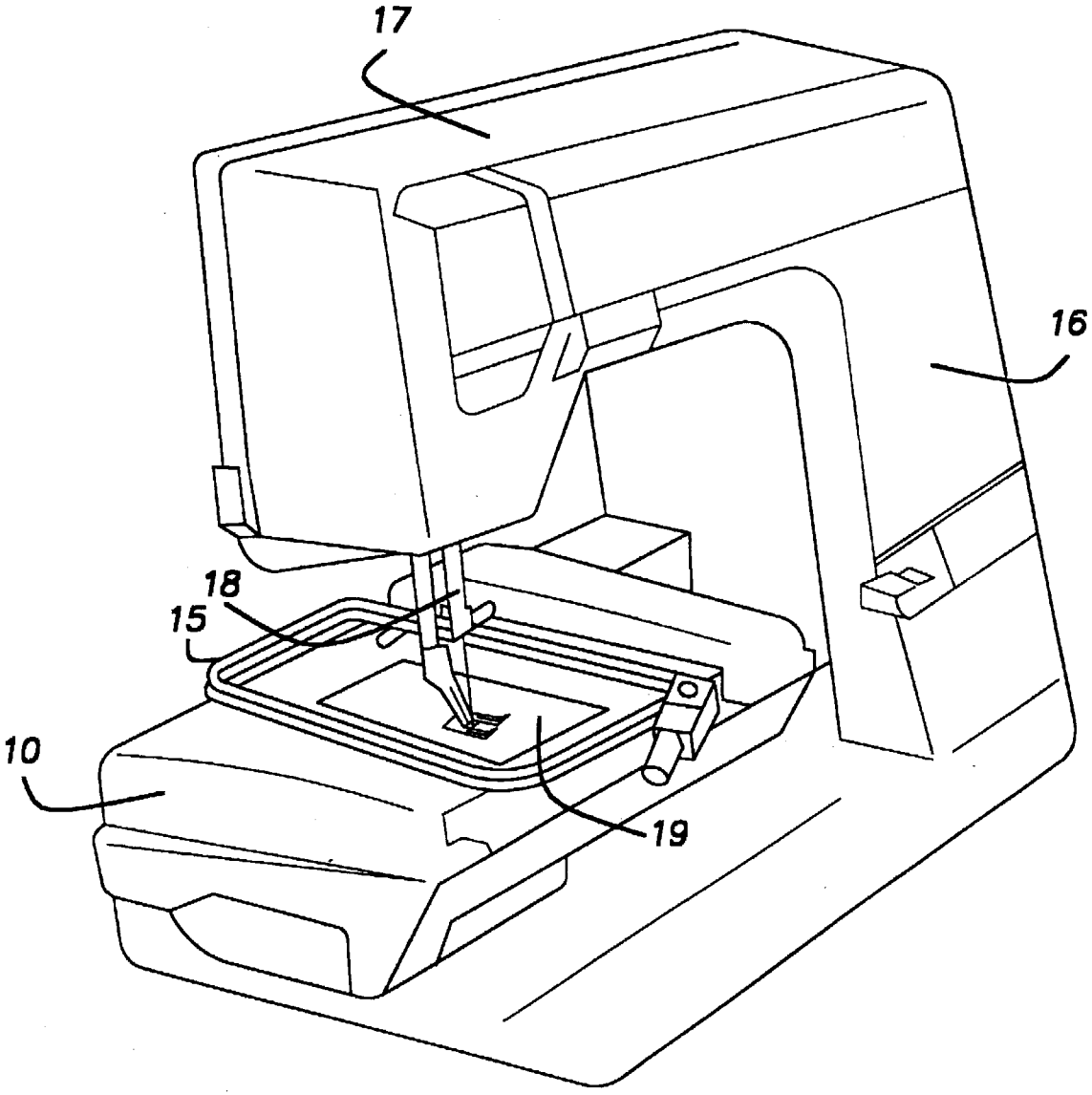
FIG. 2 illustrates the embroidery unit shown in FIG. 1 attached to a sewing machine.
Figure 3:
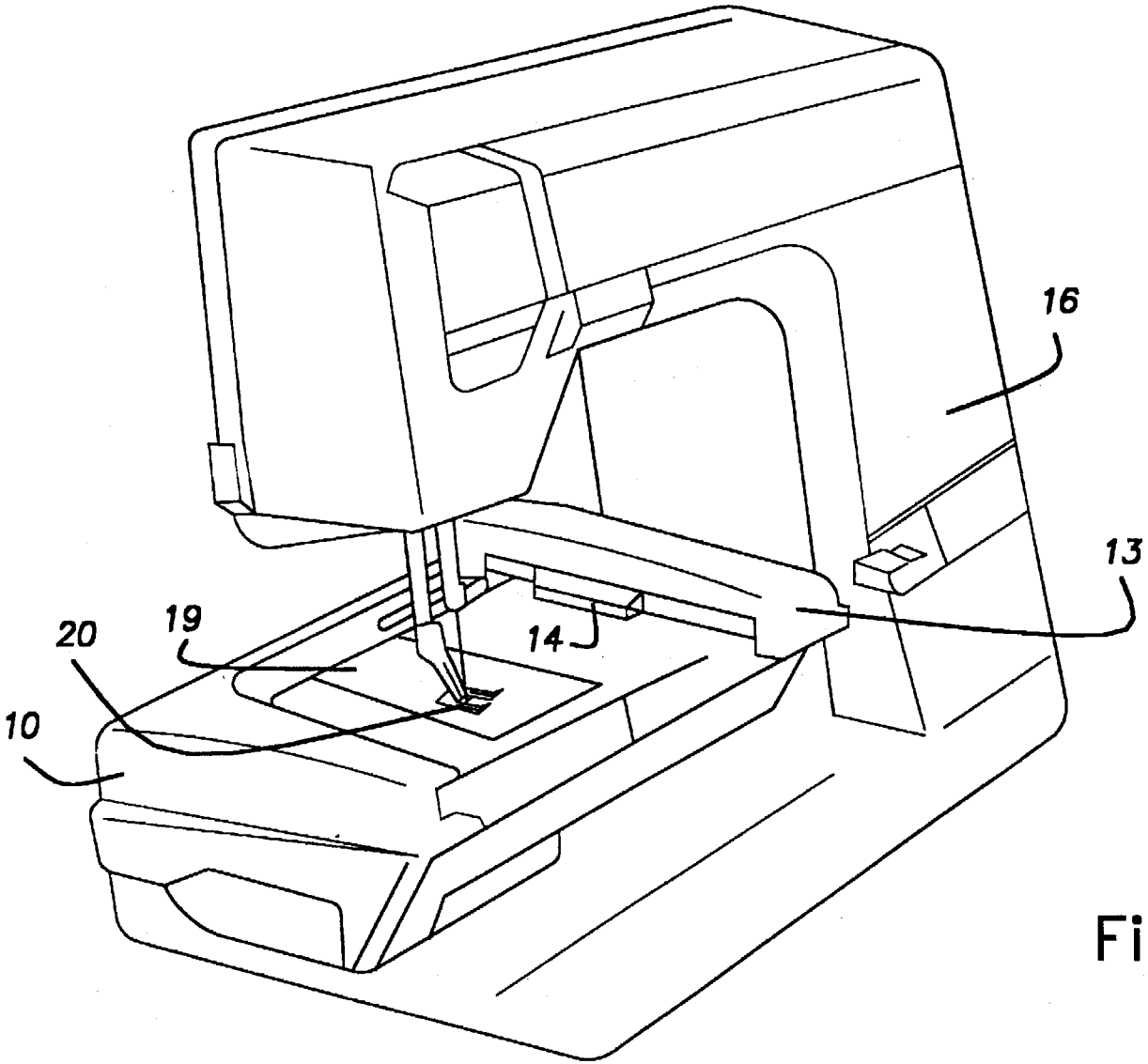
FIG. 3 is a view corresponding to FIG. 2, but with the embroidery unit in a storage position on the sewing machine.
Figure 1:
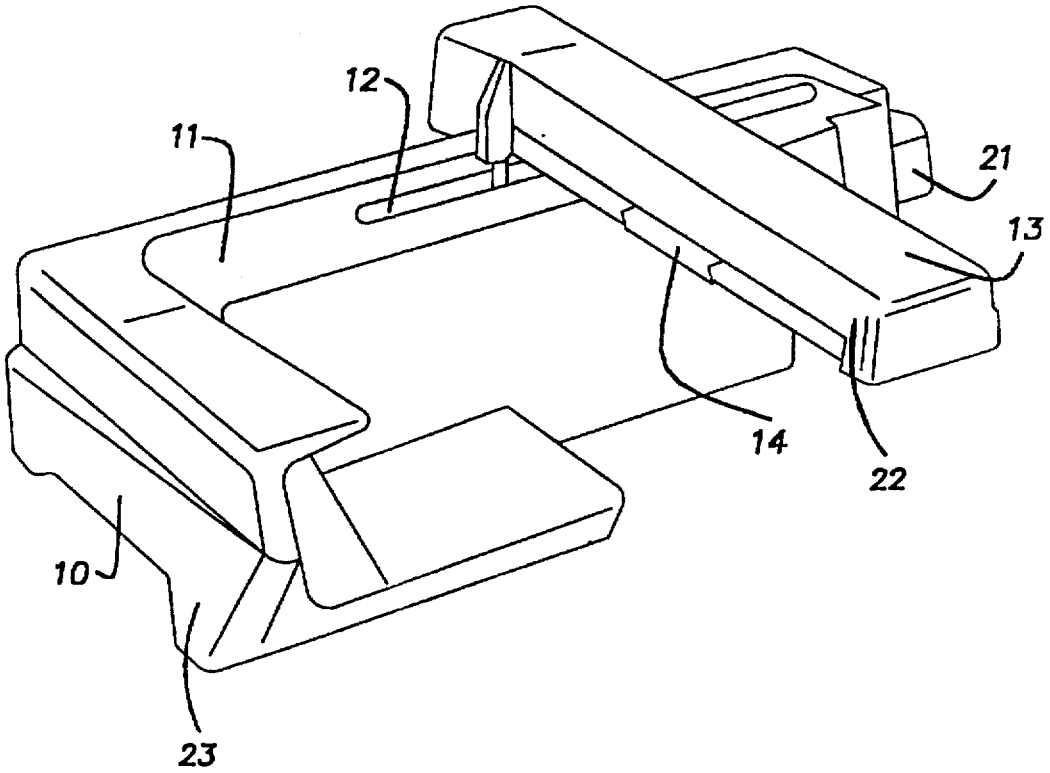

FIGS. 2 and 3 show the embroidery unit mounted to a sewing machine. The machine comprises a column 16 having a drive unit (not shown), a top arm 17 having a needle bar mechanism 18, and a lower free arm 19 having a cloth feed dog 20. The embroidery unit is mounted on the free arm 19 and is provided with a connector 21 (FIG. 1) adapted to be connected to a corresponding connector (not shown) on the sewing machine. The housing 10 has a first leg 22 oriented parallel to the free arm of the sewing machine when the housing is secured to the free arm, and a second leg 23 transversely oriented to said first leg. The first and second legs are affixed to each other at respective first ends thereof as seen in FIG. 1.

The first, stationary arm 11 of the embroidery unit is provided with stepping motors (not shown) for driving the first and second slides 12, 14, respectively. The first slide 12, moves the second, movable arm 13 parallel to the free arm 19 of the sewing machine. The second slide 14 moves along the length of the second arm 13 and perpendicularly to the free arm 19. Consequently, the hoop 15 shown in FIG. 2, which is attached to the second slide 14, is movable in two mutually perpendicular directions by means of the first and second slides 12, 14.

Each of the slides 12, 14 preferably has a drive unit (not shown) comprising a drive belt driven by a stepping motor via a gear. In addition, each slide 12, 14 is rotatably attached to a single shaft and, consequently, the second arm 13 extends from the first arm in a cantilever fashion and, therefore, has a free or unattached end. The design has thereby been simplified as compared to the prior art, and mounting of the embroidery unit on the sewing machine, and removal therefrom, has been facilitated.

In FIG. 3, the arm 13 is shown displaced to its right end position adjacent to the column 16 of the sewing machine, and the hoop 15 has been removed from the second slide 14, which is facilitated by the fact that the hoop 15 is slidably attachable to the second slide 14 and is thereby easily removed therefrom. When the second arm 13 is set to the position illustrated in FIG. 3, the sewing machine can be used for normal sewing without any essential obstruction by the embroidery unit. It is thereby possible to quickly and simply switch between embroidery sewing and normal sewing without having to remove the embroidery unit from the sewing machine.

Although the preferred embodiment of this invention has been shown and described, it should be understood that various additions, modifications, and rearrangements of parts may be resorted to without departing from the scope of the invention as defined by the claims appended hereto.

What is claimed:

1. A sewing machine and embroidery unit detachable therefrom, said sewing machine including a lower free arm provided with a cloth feed dog, a column having a drive unit, and a top arm having a needle bar mechanism, said embroidery unit comprising:

a housing releasably secured to said free arm of said sewing machine, wherein said housing has (i) a first leg oriented parallel to said free arm when said housing is secured to said free arm, said first leg having a first end and a second end, and (ii) a second leg transversely oriented to said first leg, said second leg having a first end and a second end, said first end of said second leg affixed to said first end of said first leg;

a first stationary arm disposed along said first leg of said housing;

a first slide disposed in said first stationary arm providing movement along said first arm in a direction parallel to said free arm of said sewing machine;

a second movable arm slidably affixed to said housing by affixment of an end of said second arm to said first slide, said second arm extending from said attached end in a direction perpendicular to said free arm of said sewing machine, wherein said second arm is slidably movable in said direction parallel to said free arm of said sewing machine between said feed dog and said column of said sewing machine;

a second slide in said second arm providing movement along said second arm in a direction perpendicular to said free arm of said sewing machine; and a hoop affixed to said second slide, wherein said first and second slides enable said hoop to be movable in said direction parallel to said free arm and said direction perpendicular to said free arm of said sewing machine.

2. The sewing machine and detachable embroidery unit according to claim 1 wherein said second arm is movable to an inoperative position adjacent said column of said sewing machine.

3. An embroidery unit comprising:

a housing adapted for releasable attachment to a sewing machine, wherein said housing comprises a first leg having first and second ends and a transversely oriented second leg having first and second ends, said first and second legs affixed to each other at one of their first and second ends;

a first stationary arm extending along and affixed to at least a portion of said first leg of said housing;

a first slide disposed in said first arm, said first slide extending in a direction parallel to said first leg of said housing;

a second movable arm slidably affixed to said first arm by attachment of an end of said second arm to said first slide, said second arm extending from said end attached to said first slide in a direction perpendicular to said first leg of said housing, said second arm being slidably movable in a direction parallel to said first leg of said housing by action of said first slide;

a second slide disposed in said second arm, said second slide extending in a direction perpendicular to said first leg of said housing; and a hoop releasably affixed to said second slide, whereby said first slide enables said hoop to be moved in a direction parallel to said first leg of said housing and said second slide enables said hoop to be moved in a direction perpendicular to said first leg of said housing.

* * * * *

UNITED STATES PATENT AND TRADEMARK OFFICE

CERTIFICATE OF CORRECTION

PATENT NO. : 5,666,894

DATED : September 16, 1997

INVENTOR(S) : Ake Jonsson and Hans Grufman

It is certified that error appears in the above-indentified patent and that said Letters Patent is hereby corrected as shown below:

The title page should be deleted to appear as per attached.

Sheet 1 of 3, figure 1 should be deleted to appear as per attached.

Signed and Sealed this

Ninth Day of February, 1999

*Attest:*

*Acting Commissioner of Patents and Trademarks*

*Attesting Officer*

US005666894A

United States Patent [19]

Jönsson et al.

[11] Patent Number: 5,666,894

[45] Date of Patent: Sep. 16, 1997

[54] EMBROIDERY UNIT FOR SEWING MACHINE

[75] Inventors: Åke Jönsson, Jönköping; Hans Grufman, Huskvarna, both of Sweden

[73] Assignee: Aktiebolaget Electrolux, Stockholm, Sweden

[21] Appl. No.: 490,646

[22] Filed: Jun. 15, 1995

[30] Foreign Application Priority Data

Aug. 12, 1994 [SE] Sweden ..... 9402710

[51] Int. Cl.[6] ..... D05C 9/04

[52] U.S. Cl. ..... 112/103; 112/470.06

[58] Field of Search ..... 112/103, 102.5, 112/102, 470.06, 78, 2, 260, 270

[56] References Cited

U.S. PATENT DOCUMENTS

| | | | |
|---|---|---|---|
| 4,325,313 | 4/1982 | Kawai et al. | 112/103 |
| 4,388,883 | 6/1983 | Hirota et al. . | |
| 4,763,586 | 8/1988 | Takenoya et al. . | |
| 5,040,474 | 8/1991 | Kamijyo . | |
| 5,231,941 | 8/1993 | Wakayama | 112/103 X |
| 5,284,104 | 2/1994 | Hori | 112/103 X |
| 5,291,843 | 3/1994 | Hori . | |
| 5,386,789 | 2/1995 | Futamura | 112/103 X |

*Primary Examiner*—Peter Nerbun

*Attorney, Agent, or Firm*—Pearne, Gordon, McCoy & Granger LLP

[57] ABSTRACT

An embroidery unit for use with a sewing machine, the sewing machine having a lower free arm (19) with a cloth feed dog (20), a column (16) with a drive unit, and a top arm (17) with a needle bar mechanism (18). The embroidery unit has a housing (10) which can be releasably attached to the free arm of the sewing machine. The housing has a first, stationary arm (11) provided with a first, stepping motor driven slide (12) movable parallel to the free arm. A second, movable arm (13) extends perpendicularly to the free arm and has a free end and an end attached to the first slide. The second arm is movable above the free arm between the feed dog (20) and the column (16) and has a second, stepping motor powered slide (14) carrying a hoop (15) which, by operation of the two slides, is movable in two mutually perpendicular directions. The second arm is movable to an inoperative position adjacent to the column (16) in order to enable normal sewing without having to remove the embroidery unit from the sewing machine.

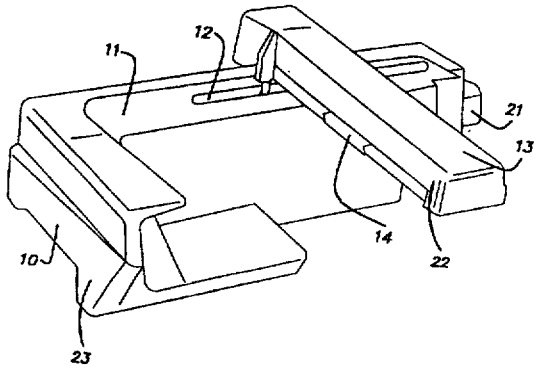

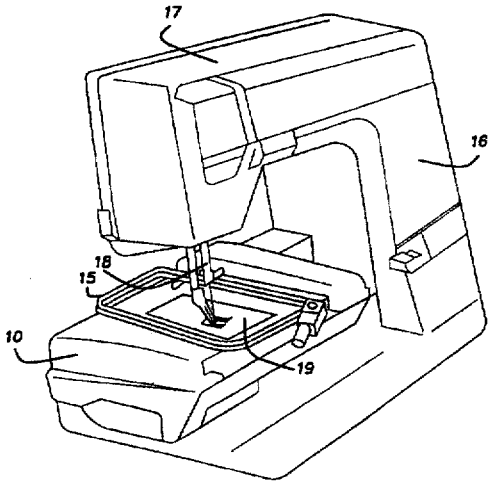

3 Claims, 3 Drawing Sheets